US008299715B2

(12) United States Patent
Philippbar et al.

(10) Patent No.: US 8,299,715 B2
(45) Date of Patent: Oct. 30, 2012

(54) TEMPERATURE COMPENSATED DRIVER FOR PULSED DIODE LIGHT SOURCE

(75) Inventors: Jay Philippbar, San Clemente, CA (US); David Giorgi, Solana Beach, CA (US)

(73) Assignee: OmniPulse Technology Corporation, San Diego, CA (US)

( * ) Notice: Subject to any disclaimer, the term of this patent is extended or adjusted under 35 U.S.C. 154(b) by 178 days.

(21) Appl. No.: 12/789,819

(22) Filed: May 28, 2010

(65) Prior Publication Data

US 2011/0291578 A1 Dec. 1, 2011

(51) Int. Cl.
*H01J 7/24* (2006.01)
*H05B 37/02* (2006.01)

(52) U.S. Cl. ..... 315/112; 315/113; 315/224; 315/291; 315/307

(58) Field of Classification Search ..... 315/112, 315/113, 224, 291, 307
See application file for complete search history.

(56) References Cited

U.S. PATENT DOCUMENTS 4,053,733 A * 10/1977 Murata et al. ..... 219/494
5,303,248 A 4/1994 Gibbs
5,821,700 A * 10/1998 Malvaso ..... 315/291
6,587,490 B2 7/2003 Crawford
7,262,584 B2 * 8/2007 Crawford et al. ..... 323/272
7,545,839 B2 6/2009 Giorgi et al.
8,184,670 B2 * 5/2012 Crawford et al. ..... 372/38.02

OTHER PUBLICATIONS

Analog Modules, Inc., Model 772A Data Sheet, Oct. 2008, 2 pages.
Optiswitch Technology Corporation, PLDD-200-1-1 Data Sheet, Nov. 9, 2009, 3 pages.
Optiswitch Technology Corporation, PLDD-200-12-20 Data Sheet, Nov. 23, 2009, 3 pages.
Optiswitch Technology Corporation, PLDD-200-ULW-3 Data Sheet, Jan. 23, 2009, 3 pages.
Optiswitch Technology Corporation, PLDD-300-1-20 Data Sheet, Jan. 9, 2010, 3 pages.

* cited by examiner

*Primary Examiner* — Douglas W Owens
*Assistant Examiner* — Thai Pham
(74) *Attorney, Agent, or Firm* — David H. Carroll

(57) ABSTRACT

A pulsed diode light source driver includes a variable output power supply, an output capacitor, a switchable linear current driver, a temperature sensor, a conditioning circuit, and a voltage monitor. The temperature sensor monitors the temperature of the capacitor while the voltage monitor circuit monitors the output voltage level. The conditioning circuit and the voltage monitor cooperatively control the output voltage of the variable output power supply, so that temperature-related changes in the characteristics of the capacitor are compensated for, and a constant current is maintained through the diode load over a desired range of temperature. The driver is suitable for laser diodes and light emitting diodes.

15 Claims, 5 Drawing Sheets

TEMPERATURE COMPENSATED DRIVER FOR PULSED DIODE LIGHT SOURCE

BACKGROUND OF THE INVENTION

1. Field of the Invention

The present invention relates to drivers for a pulsed diode light source, and more particularly to drivers for a pulsed diode light source suitable for improved temperature range operation.

2. Description of Related Art

Pulsed laser diode drivers typically are used to generate pulses of current into one or more laser diodes. Pulsed laser diode drivers are manufactured and sold by a variety of companies, including OptiSwitch Technology Corporation of San Diego, Calif., USA; Analog Modules, Inc. of Longwood, Fla., USA; Avtech Electrosystems Ltd. of Ogdensburg, N.Y., USA; and Directed Energy, Inc., an IXYS Company, of Fort Collins, Colo., USA.

FIG. 1 shows one type of pulsed laser diode driver in which a linear pass element 130 such as a field effect transistor functions as a current driver in a series circuit with a voltage regulated power supply 100 and a laser diode load 120. The linear pass element 130 is part of a linear current source which includes a current sensing element 140 and an error amplifier 150. The current sensing element 140 is placed in the series circuit such that the voltage which develops across the current sensing element 140 is in proportion to the amount of current being conducted through the laser diode load 120. The error amplifier 150 compares the voltage which develops across the current sensing element 140 with a control voltage that is applied at terminal 160 to indicate the desired laser diode current, and adjusts the current conducted by the linear pass element 130 to maintain a constant current. A capacitor 110 is connected across the power supply 100 to provide adequate energy storage so that the delivered pulse keeps the linear current source operating within its linear regime.

The characteristics of capacitors are affected by temperature, which can adversely impact the ability of the driver to maintain a constant current through the laser diode load. The impact on current level can be reduced by using large capacitor banks and operating the linear pass element close to saturation. Unfortunately, the use of large capacitor banks increases the size, weight and bulkiness of the driver, which may be undesirable in some applications.

SUMMARY OF THE INVENTION

One embodiment of the present invention is a pulsed diode light source driver comprising a diode driver section comprising a switchable linear current driver coupled in series with a plurality of diode nodes for connecting to a diode light source; a power supply having an output coupled to the diode driver section for providing an output voltage thereto, and an adjust node for controllably varying the output voltage as a function of deviation in an electrical property at the adjust node from a predetermined value; an output capacitor coupled to the output of the power supply; a temperature sensor physically disposed relative to the output capacitor for indicating temperature thereof with a temperature-varying signal; a conditioning circuit for perturbing the electrical property at the adjust node from the predetermined value as a function of the temperature-varying signal to thereby vary the output voltage of the power supply in accordance with a voltage-temperature profile for the output capacitor, the conditioning circuit being coupled to the temperature sensor for receiving the temperature-varying signal; and a voltage monitor for restoring the electrical property at the adjust node to the predetermined value as a function of change in the output voltage of the power supply to thereby vary the output voltage of the power supply in accordance with the voltage-temperature profile for the output capacitor, the voltage monitor being coupled to the output of the power supply. The pulsed diode light source driver is operable for maintaining current pulses from the diode driver section constant over a temperature range, and the voltage-temperature profile for the output capacitor is operatively effective for maintaining current pulses from the diode driver section constant over a low end of the temperature range. In one variation, the conditioning circuit is for perturbing the electrical property at the adjust node from the predetermined value to a perturbed value as a function of the temperature-varying signal, and the voltage monitor is for restoring the electrical property at the adjust node from the perturbed value to the predetermined value as a function of change in the output voltage of the power supply Another embodiment of the present invention is a pulsed diode light source system comprising a diode driver section comprising a diode light source and a switchable linear current driver coupled in series with the diode light source; a power supply having an output coupled to the diode driver section for providing an output voltage thereto, and an adjust node for controllably varying the output voltage; an output capacitor coupled to the output of the power supply; a temperature sensor physically disposed relative to the output capacitor for indicating temperature thereof with a temperature-varying signal; a conditioning circuit for perturbing the electrical property at the adjust node from the predetermined value as a function of the temperature-varying signal to thereby vary the output voltage of the power supply in accordance with a voltage-temperature profile for the output capacitor, the conditioning circuit being coupled to the temperature sensor for receiving the temperature-varying signal; and a voltage monitor for restoring the electrical property at the adjust node to the predetermined value as a function of change in the output voltage of the power supply to thereby vary the output voltage of the power supply in accordance with the voltage-temperature profile for the output capacitor, the voltage monitor being coupled to the output of the power supply. The pulsed diode light source driver is operable for maintaining current pulses from the diode driver section constant over a temperature range, and the voltage-temperature profile for the output capacitor is operatively effective for maintaining current pulses from the diode driver section constant over a low end of the temperature range.

Another embodiment of the present invention is a method for driving a diode light source with current pulses, comprising driving the diode light source with current pulses from a switchable linear current driver over an operating temperature range; providing an output voltage from an output of a variable output power supply to the switchable linear current driver, the output having an output capacitor coupled thereto; sensing temperature of the output capacitor with a temperature sensor physically disposed relative to the output capacitor for indicating temperature thereof; and increasing the output voltage from the variable output power supply in response to an indication from the temperature sensor of decreasing temperature within a low end of the operating temperature range, to maintain constant the current pulses from the switchable linear current driver to the diode light source. In a variation, the method may further comprise decreasing the output voltage from the variable output power supply in response to an indication from the temperature sensor of increasing temperature within a high end of the operating temperature range, to maintain constant the current pulses from the switchable linear current driver to the diode light source.

DETAILED DESCRIPTION OF THE INVENTION, INCLUDING THE BEST MODE

Many applications that use pulsed laser diode drivers in varying temperature environments would benefit from smaller and lighter weight units. Examples of such applications include laser rangefinders, laser illuminators, laser designators, laser markers, and commercial diode pumped laser systems. For applications in which a bulky driver is undesirable, capacitors offering similar levels of capacitance as other types of capacitors but in a smaller and lighter physical implementation may be used. A suitable type of capacitor is, for example, an aluminum electrolytic capacitor. Moreover, a smaller capacitance value may be used if the linear pass element in the driver is operated so that it is away from saturation initially and approaches saturation at the end of the pulse period, while maintaining constant current during the pulse. This also helps to decrease the size and weight of the driver.

Some types of capacitors are particularly susceptible to temperature-related changes in their equivalent series resistance, or ESR. In these types of capacitors, the ESR increases at low temperatures, and decreases at high temperatures. In an aluminum electrolytic capacitor, for example, ESR increases radically with decreasing low temperatures. The increase in ESR at low temperature tends to affect the ability of the driver to maintain the desired current level, while the decrease in ESR at high temperature tends to increase switching losses in the linear pass element.

To compensate for the effect of temperature on the ESR of the capacitor, an effect to which the aluminum electrolytic type of capacitor is particularly susceptible, a pulsed laser diode driver is described herein which monitors the temperature of the capacitor and suitably adjusts the voltage applied to it so as to maintain a constant current through the laser diode load over a desired range of temperature. It will be appreciated that the term "constant current pulses" is defined by the context of the application to mean current pulses whose variations do not exceed the level specified for the application. Advantageously, the pulsed laser diode driver may be made particularly small and lightweight for a given temperature range that includes low temperatures, or the pulsed laser diode driver may be made to operate over an extended temperature range that includes low temperatures for a given size and weight. The temperature compensation circuit may also be used at high temperatures to improve the energy efficiency of the pulsed laser diode driver.

Figure 1:
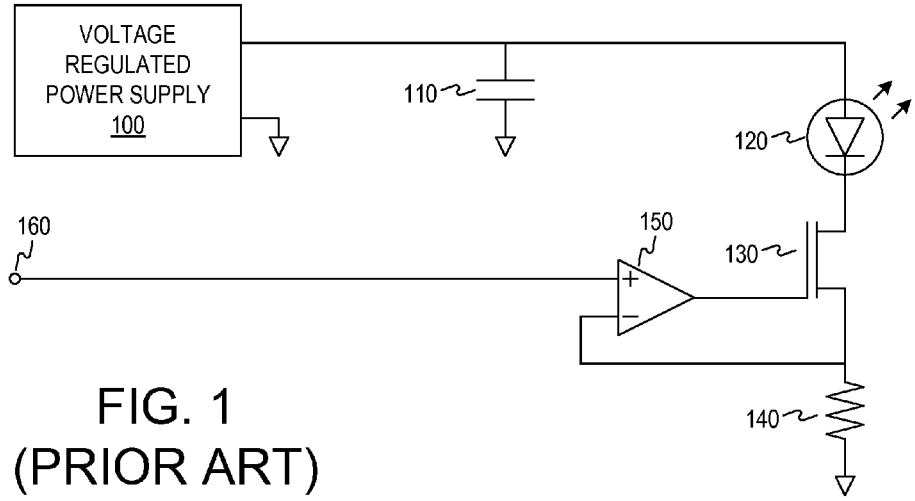
FIG. 1 (PRIOR ART)
FIG. 1 is a schematic diagram of a prior art pulsed laser diode driver circuit.
Figure 2:
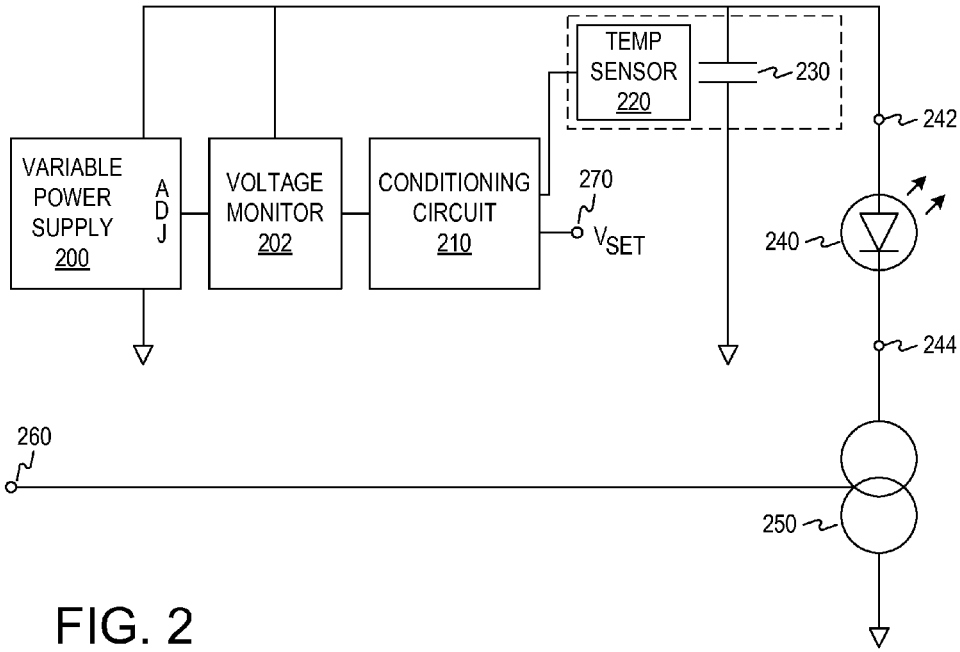
FIG. 2 is a block schematic diagram of a pulsed laser diode driver circuit in accordance with the present invention.

FIG. 2 is a block schematic diagram of a temperature compensated pulsed laser diode driver. Illustratively, a switchable linear current driver 250 controlled by a trigger signal applied to terminal 260 provides constant current pulses for a laser diode 240. As indicated by nodes 242 and 244, the laser diode 240 may be pre-mounted by the manufacturer with the pulsed laser diode driver, or may be connected separately by the user. As used herein, the term "laser diode" includes an individual diode device, bars and arrays of diode devices, bars, arrays and/or individual devices connected in parallel, and bars, arrays and/or individual devices connected in series. Many different types of laser diodes are available, including, for example, double heterostructure lasers, quantum well lasers, quantum cascade lasers, separate confinement heterostructure lasers, distributed feedback lasers, vertical-cavity surface-emitting lasers, vertical-external-cavity surface-emitting lasers, and external-cavity diode lasers. Because laser diodes tend to have an extremely low on-resistance—arrays in common use today typically have a resistance of less than 20 milliohms, for example—the current driver 250 should be capable of driving a pulse having a fast rise time for a given flat top current. Power for the pulsed laser diode is provided by power supply 200 and an output storage capacitor 230. The power supply 200 may be a power supply of any suitable type, illustratively either a linear power supply or a switching power supply, having a controllably variable voltage output and having sufficient power to charge up the capacitor 230 to a sufficient level to power the laser diode 240. The power supply 200 may include an output voltage adjust node ADJ for varying the voltage level on the output by varying an electrical property (voltage, current or impedance) of the node ADJ. As used herein, the term "capacitor" may refer to a single capacitor, an array of capacitors in parallel and/or in series, or a circuit of capacitors with other components such as a pulse forming network ("PFN") of capacitors and inductors. A temperature sensor 220 provides a temperature-varying output signal representing the temperature of the capacitor 230, which is measured either directly by placing the temperature sensor 220 in contact with the capacitor 230 or in close proximity to the capacitor 230, or inferentially by measuring the temperature of the circuit board upon which the capacitor 230 is mounted, or the ambient in which the driver is being used. A conditioning circuit 210 adapts the temperature-varying signal of the temperature sensor 220, the characteristics of which are dependent on the type of temperature sensor, to the requirements of the output voltage adjust node ADJ of the power supply 200. The electrical characteristics of the input of the conditioning circuit 210 may be made to match the electrical characteristics of the temperature sensor 220, and the electrical characteristics of the output of the conditioning circuit 210 may be made to match the electrical characteristics of the output voltage adjust node ADJ of the power supply 200. Many different types of temperature sensors are suitable, including contact or non-contact devices such as resistive temperature devices ("RTD's"), pn junctions, linear ICs, infrared sensors, thermistors, thermocouples, and various analog types of temperature sensors. Temperature sensors having directly-varying outputs and inversely-varying outputs are both suitable, since the conditioning circuit 210 may perform the appropriate adjustment.

The output of the conditioning circuit 210 is applied to the output voltage adjust node ADJ of the power supply 200 through a voltage monitor 202 for varying the voltage output of the power supply 200, and therefore the voltage across the capacitor 230, as a function of the temperature of the capacitor 230 and the voltage output of the power supply 200. In particular, the voltage output of the power supply 200 and therefore the voltage across the capacitor 230 is increased during low temperature operation so that the laser diode 240 is driven at the desired constant current even over the low end of the range of operating temperatures. The set point of the conditioning circuit 210 is established by a voltage $V_{SET}$ applied to terminal 270. The power supply 200 is set to a suitable initial level by the voltage monitor 202, which applies a portion of the output of the power supply 200 to the output voltage adjust node ADJ.

Figure 3:
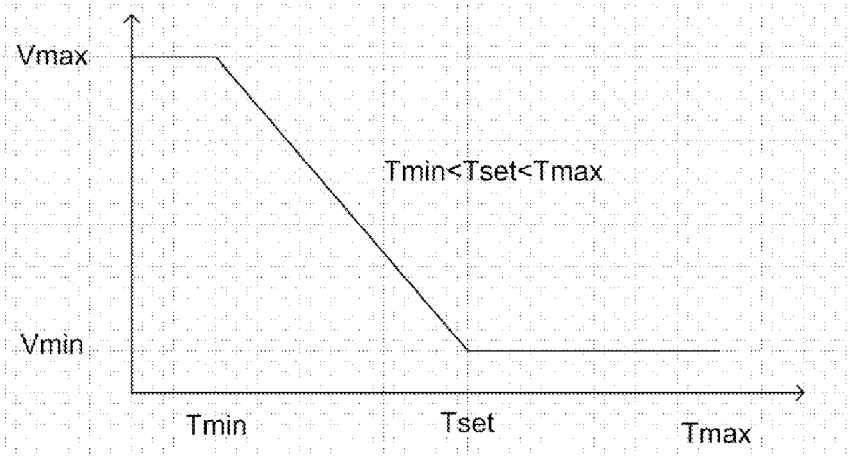
FIG. 3 is an illustrative graph of voltage on an output storage capacitor versus temperature for the pulsed laser diode driver circuit shown in FIG. 2.

The conditioning circuit 210 and the voltage monitor 202 operates as follows to maintain a constant current through the laser diode load at low temperature. When the temperature being monitored decreases to a point at which the ESR of the capacitor would otherwise begin to disrupt the constant current, the output of the power supply 200 is increased under control of the output of the conditioning circuit 210 until the input condition at the output voltage adjust node ADJ is satisfied by the voltage monitor 202. Both the conditioning circuit 210 and the voltage monitor 202 act on the output voltage adjust node ADJ in accordance with the specifications of the power supply 200 so that a suitable voltage-temperature profile for the capacitor 230 is established at the output of the power supply 200 to maintain constant current and, if desired, to optimize system efficiency. FIG. 3, for example, is an illustrative graph of voltage on output storage capacitor 230 versus temperature for a linear profile implementation of the pulsed laser diode driver circuit shown in FIG. 2. The voltage on the output storage capacitor 230 is kept constant at $V_{MIN}$ from $T_{MAX}$ to $T_{SET}$, where $T_{MAX}$ is greater than $T_{SET}$. The voltage on the output storage capacitor 230 increases linearly to $V_{MAX}$ over the range $T_{SET}$ to $T_{MIN}$ where $T_{SET}$ is greater than $T_{MIN}$. For temperatures less than $T_{MIN}$ the output voltage stays constant at $V_{MAX}$.

The conditioning circuit 210 may be modified to vary the voltage on the output storage capacitor 230 at higher temperatures to help maintain efficient operation of the current driver 250 in some implementations, and especially in systems operating at frequencies of around 20 Hertz and higher. When the temperature being monitored exceeds a predetermined value, the voltage on the capacitor 230 may be decreased. The voltage may decrease linearly or may take any profile which optimizes system efficiency. Alternatively, the voltage may be made to vary continuously in accordance with a desired profile from hot to cold and from cold to hot, or with one profile from hot to cold and another profile from cold to hot.

While many different types of capacitors are suitable for use as the capacitive device 230, the aluminum electrolytic type of capacitor is particularly suitable for applications requiring small size and weight because the aluminum electrolytic capacitor provides more capacitance per unit volume than many other types of capacitors. Unfortunately, the aluminum electrolytic type capacitor is particularly susceptible to low temperature effects. In particular, the capacitance tends to fall off below room temperature, the equivalent series resistance ("ESR") increases due to declining conductance of the electrolyte salts, and the dissipation factor ("DF") increases. While ESR behavior is different for different capacitors, an illustrative behavior for an aluminum electrolytic capacitor is an exponential increase in ESR from about 16 milliohms at 0 degrees C., to about 18 milliohms at minus 10 degrees C., to about 21 milliohms at minus 20 degrees C., to about 31 milliohms at minus 30 degrees C., and to about 68 milliohms at minus 40 degrees C. The decrease in ESR with increasing temperature is much less pronounced, with the ESR being about 9 or 10 milliohms at 40 degrees C.

The conditioning circuit 210 and the temperature sensor 220 are effective for compensating for the effects of low temperature on the aluminum electrolytic type of capacitor by suitably increasing the voltage output of the power supply 200. Moreover, if desired, the conditioning circuit 210 and the temperature sensor 220 may be used to compensate for the effects of high temperature on the capacitor 230 by suitably decreasing the voltage output of the power supply 200 to reduce switching losses in the current driver 250.

Figure 4:
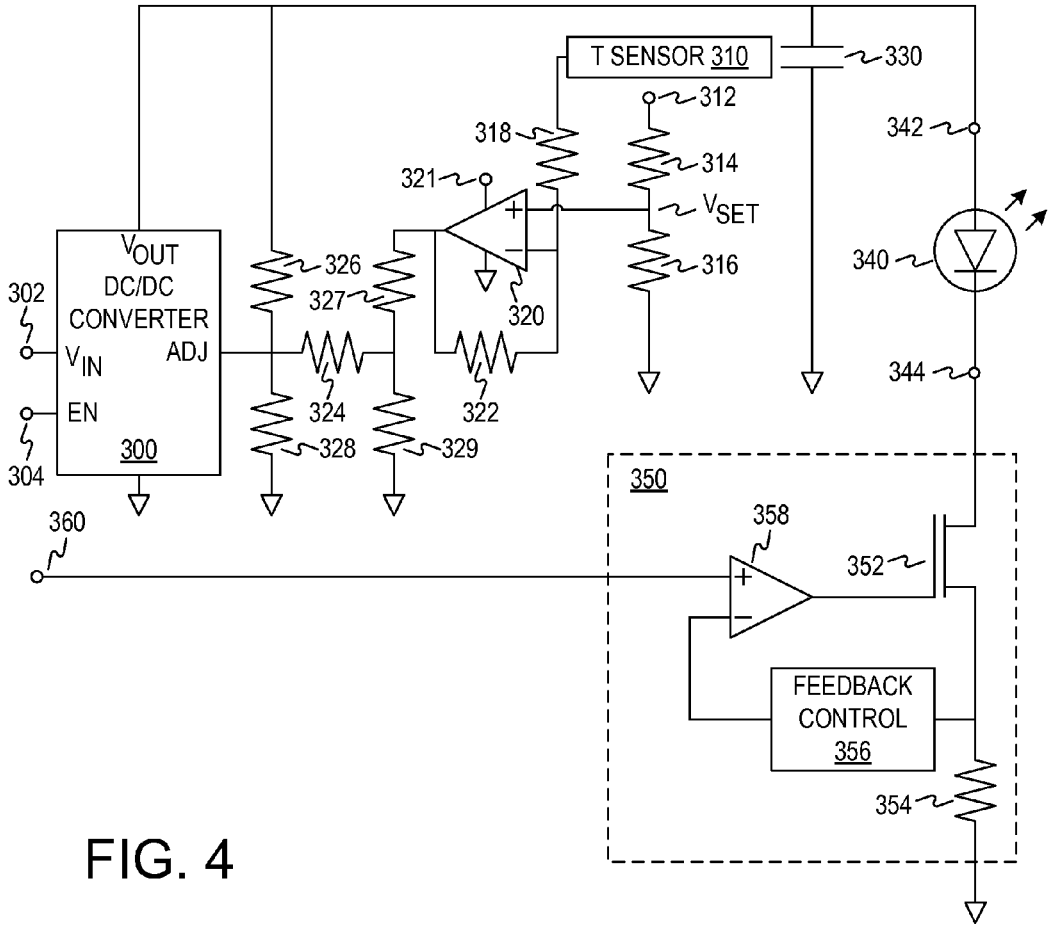
FIG. 4 is a schematic circuit diagram of an illustrative implementation of the pulsed laser diode driver circuit shown in FIG. 2.

FIG. 4 is a schematic diagram of an illustrative implementation of the pulsed laser diode driver of FIG. 2. The power supply is implemented as a DC/DC converter 300 which receives input voltage on node $V_{IN}$ from an external power source applied to terminal 302, and provides an output voltage $V_{OUT}$. The external power source may be a battery, an AC/DC power converter, or any other source of DC power. The DC/DC converter 300 also includes an output voltage adjustment node ADJ for receiving an adjustment signal, and an enable node EN for receiving an enable signal on terminal 304 to enable operation. The design of suitable DC/DC converters is well known in the art and suitable DC/DC converters are commercially available. The DC/DC converter 300 charges an aluminum electrolytic capacitor 330, and the combination powers a laser diode 340 arranged in series through nodes 342 and 344 with an illustrative switchable linear current driver 350. To protect the laser diode against reverse voltages, an anti-parallel diode may be used between nodes 342 and 344. Illustratively, the current driver 350 is implemented with a metal oxide semiconductor field effect transistor ("MOSFET") 352 operating in its linear regime as a switchable linear current pass element, and a resistor 354 as the current sensing element, connected in series with the laser diode 340. Other suitable linear current pass elements include insulated gate bipolar transistors ("IGBT") and bipolar transistors. Other suitable current sensing elements include current transformers and hall sensors. A servo is implemented with an operational amplifier 358 and a feedback control 356 having one terminal connected to the resistor 354 and the other terminal connected to the inverting input of the operational amplifier 358. The non-inverting input of the operational amplifier 358 is connected to trigger signal terminal 360. The feedback control 356 functions to maintain system stability over the desired bandwidth, and may be implemented in any desired way. Illustratively, the feedback control 356 may be implemented as a resistor-capacitor network.

The output voltage of the DC/DC converter 300 charges up the aluminum electrolytic capacitor 330 to a desired voltage based on the laser diode 340 load, the characteristics of aluminum electrolytic capacitor 330, the total circuit resistance, the on-state drop across the MOSFET 352, and the temperature of the aluminum electrolytic capacitor 330. A temperature compensation circuit is provided to control the output voltage of the DC/DC converter 300 as a function of temperature of the aluminum electrolytic capacitor 330. A temperature sensor 310 monitors the temperature of the aluminum electrolytic capacitor 330, and supplies a temperature signal through resistor 318 to the inverting input of an operational amplifier 320. A set voltage $V_{SET}$ formed by dividing a voltage at node 312 with resistors 314 and 316 is applied to the non-inverting input of the operational amplifier 320. The operational amplifier 320 receives power at terminal 321, and includes a feedback resistor 322 connected between its output and the inverting input. The output of the operational amplifier 320 is an error signal which is divided by resistors 327 and 329 and applied through resistor 324 to the output voltage adjust node ADJ of the DC/DC inverter 300 to control the voltage level $V_{OUT}$ at the output. A voltage divider formed by resistors 326 and 328 is connected to the output of the DC/DC inverter 300 and has its midpoint connected to the output voltage adjust node ADJ to set the voltage at the output of the DC/DC inverter 300 to a suitable initial level, and to satisfy the input condition at the output voltage adjust node ADJ when the output of the DC/DC inverter 300 has increased to the desired level. The voltage divider formed by resistors 326 and 328 is one illustrative technique for implementing a voltage monitor, and other suitable techniques will be known to one of ordinary skill in the art upon a study of this patent document.

An illustrative set of suitable values is as follows: capacitor 330 6700 μF, resistor 314 150 KΩ, resistor 316 698 KΩ, resistor 318 10 KΩ, resistor 322 60.4 KΩ, resistor 327 57.6 KΩ, resistor 329 34.0 KΩ, resistor 324 1 KΩ, resistor 326 300 KΩ, resistor 328 22.6 KΩ, and resistor 354 1 mΩ. Other suitable values for the temperature compensating components of the circuit of FIG. 4 may be determined by a person of ordinary skill in the art upon a study of this patent document.

The pulsed laser diode driver of FIG. 4 operates as follows. Current pulses flow through the series path that includes the laser diode 340, the MOSFET 352, and the current sensing resistor 354. The voltage drop across the current sensing resistor 354 is applied by the feedback control 356 to the inverting input of the operational amplifier 358, which compares the value to an input voltage (DC or pulsed) applied to the terminal 360 to determine the required gate drive to the MOSFET 352 for a constant current operation of the laser diode 340. If the voltage at the terminal 360 is a DC signal, the operational amplifier 358 would need to be enabled and disabled in order to generate the current pulse through the laser diode 340.

Temperature and particularly low temperature affects certain characteristics of the aluminum electrolytic capacitor 330 which can in turn disrupt the constant current. To compensate for these disturbances, the temperature sensor 310 monitors the capacitor temperature, and the operational amplifier 320 responds to the signal from the temperature sensor 310 to establish a suitably conditioned temperature-varying control signal on the output voltage adjust node ADJ of the DC/DC converter 300, the control signal being suitable conditioned to implement the desired voltage-temperature profile for the capacitor 330 to compensate for temperature. At low temperature, the ESR of the capacitor 330 significantly increases, so that to compensate, the voltage on the capacitor 330 is increased to a level suitable for maintaining the current through the laser diode 340 constant.

The voltage output $V_{OUT}$ of the DC/DC converter 300 varies depending on the control signal, illustratively a voltage level, applied to the output voltage adjust node ADJ. If the voltage at the ADJ node is less than the internal reference voltage, the voltage output $V_{OUT}$ increases. Conversely, if the voltage at the ADJ node is greater than the internal reference voltage, the voltage output $V_{OUT}$ decreases. The illustrative temperature compensation circuit functions by the sourcing or sinking of current into and out of the ADJ node by use of the operational amplifier 320. If the sensed temperature is above $T_{SET}$, the output voltage of the operational amplifier 320 is such that the voltage at the ADJ node equals the internal reference voltage of the DC/DC converter 300. In this condition no current flows into or out of the ADJ node, and the voltage output $V_{OUT}$ of the DC/DC converter 300 is unchanged. If the temperature falls below $T_{SET}$, then the output voltage of the operational amplifier 320 falls so that the voltage at the ADJ node falls below the internal reference voltage of the DC/DC converter 300 and the operational amplifier 320 sinks current, thus causing the voltage output $V_{OUT}$ of the DC/DC converter 300 to increase. As $V_{OUT}$ increases, the voltage at the midpoint of resistors 326 and 328 increases until it equals the internal reference voltage, at which point $V_{OUT}$ stops increasing. If the temperature reverses and begins to rise toward $T_{SET}$, then the output voltage of the operational amplifier 320 rises so that the voltage at the ADJ node rises above the internal reference voltage of the DC/DC converter 300 and the operational amplifier 320 sources current, thus causing the voltage output $V_{OUT}$ of the DC/DC converter 300 to decrease. As $V_{OUT}$ decreases, the voltage at the midpoint of resistors 326 and 328 decreases until it equals the internal reference voltage, at which point $V_{OUT}$ stops decreasing.

If it is desired to decrease the voltage on the capacitor 330 at high temperatures to avoid switching losses at the MOSFET 352, additional temperature compensation circuit elements may be added to implement a suitable high temperature profile for the voltage on the output storage capacitor.

The temperature sensor 310 may be placed in contact with or as close to the capacitor 330 as practical to measure the temperature of the capacitor. Alternatively, the temperature of the capacitor may be measured inferentially by positioning the temperature sensor to measure the temperature of the circuit board generally or the temperature of the ambient. If a bank of capacitors is used, two or more temperature sensors may be used to monitor temperature across the capacitor bank, or at each capacitor if desired. The temperature signals from the temperature sensors may be averaged or combined in accordance with a particular algorithm to provide an optimal temperature reading for the temperature compensation circuit.

Figure 5:
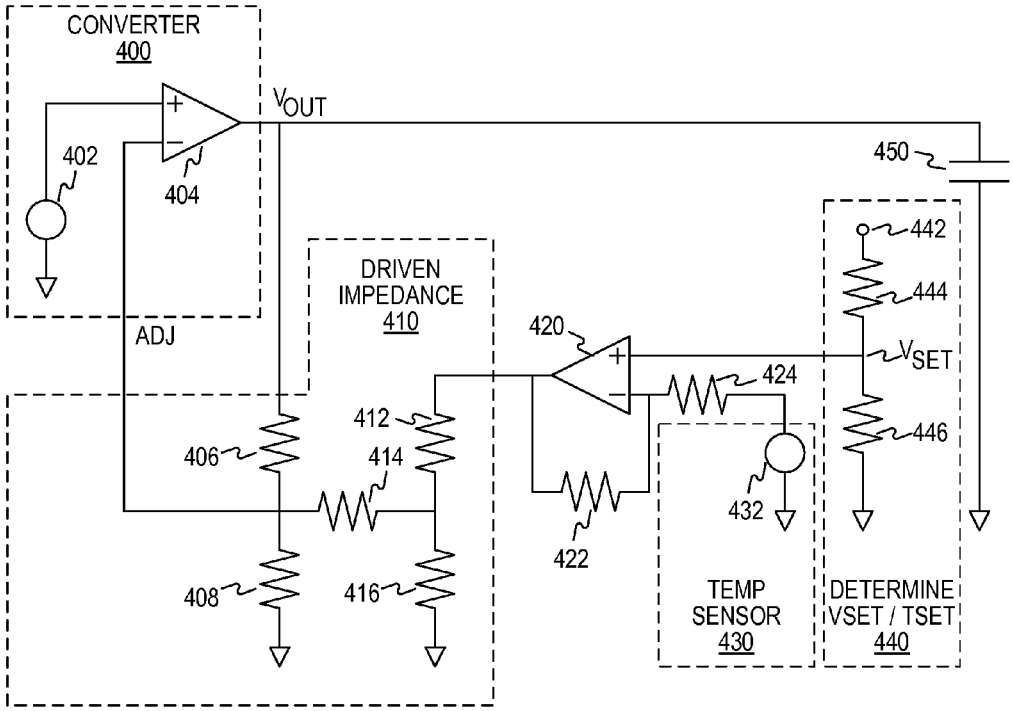
FIG. 5 is a schematic circuit diagram of an illustrative model for a SPICE simulation of the pulsed laser diode driver circuit shown in FIG. 2.

The circuit of FIG. 4 was simulated in SPICE using the illustrative model shown in FIG. 5. The components of the model are as follows. A DC/DC converter 400 was simulated by an operational amplifier 404 which received 1.25 volts on its non-inverting input from an internal voltage reference source 402, and an output voltage adjust signal on its inverting input ADJ. The voltage output $V_{OUT}$ of the simulated DC/DC converter 400 was applied to an output capacitor 450 and to a voltage divider formed by 220 kΩ resistor 406 and 15 kΩ resistor 408 connected in series, with its midpoint being connected to the output voltage adjust node ADJ. The conditioning circuit was simulated using operational amplifier 420, which had a feedback path formed by 200 kΩ resistor 422 connected between the inverting input and output of the operational amplifier 420. A temperature sensor 430 was simulated using a 200 msec pulse voltage source 432 which was applied to the inverting input of the operational amplifier 420 through 32 kΩ resistor 424. The set voltage $V_{SET}$ applied to the non-inverting input of the operational amplifier 420 was provided by a voltage divider formed with a 150 kΩ resistor 444 and a 698 kΩ resistor 446 connected in series, to which 3.3 volts was applied at node 442. The driven impedance 410 of the operational amplifier 420 was modeled by a voltage divider formed by 32 kΩ resistor 412 and 19.6 kΩ resistor 416 connected in series, with the midpoint being connected to the output voltage adjust node ADJ through a 17 k• resistor 414. Resistors 406 and 408 are included in the driven impedance 410.

Figure 6:
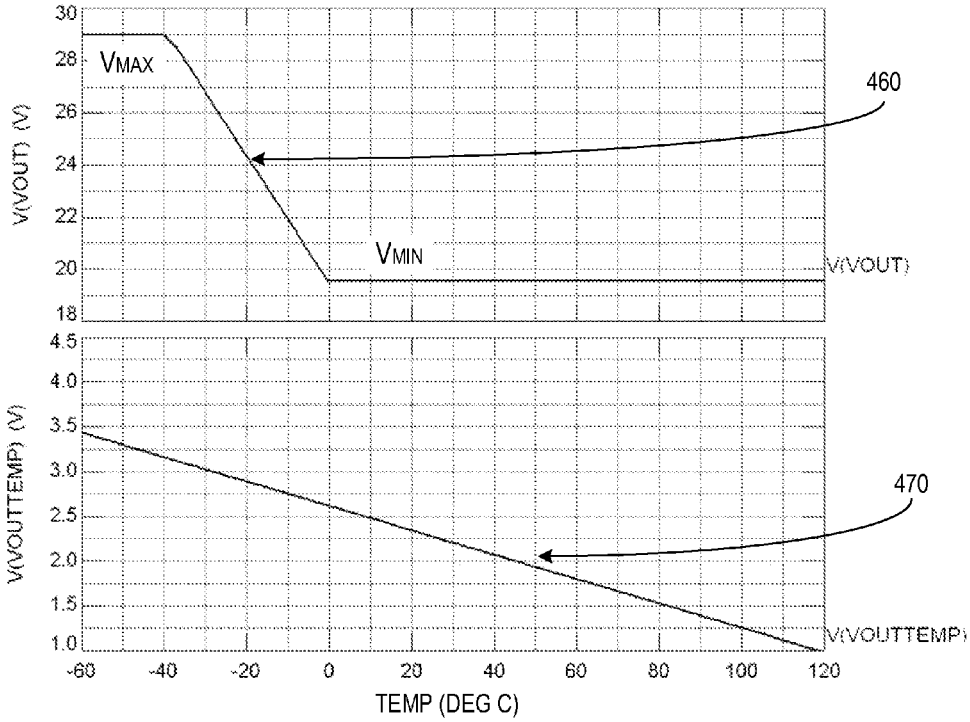
FIG. 6 is an illustrative graph of voltage from a SPICE simulation of the model of FIG. 5.

The simulation input and output for the model of FIG. 5 are shown in FIG. 6. For temperatures below the set point of zero degrees Celsius, the output of operational amplifier 420 was high at 3.3 volts. The voltage divider formed by the resistors 412 and 416 along with the resistor 414 reduced this output voltage to 1.25 volts at the output voltage adjust node ADJ of the converter 400. As 1.25 volts was the internal voltage reference 402 of the converter 400, the voltage on the capacitor 450 remained constant at 19.5 volts. However, when the output 470 of the temperature sensor 430 began to fall below 2.62 volts as the temperature declined past zero degrees Celsius, it fell below the temperature set point as established by the circuit 440. The output of the operational amplifier 420 was reduced, which in turn caused the voltage at the adjust node ADJ to be reduced below the internal voltage reference 402 of the converter 400. As a result, the output of the operational amplifier 404 rose, and the capacitor voltage $V_{OUT}$ thereby was increased until the voltage at the output voltage adjust node ADJ again reached 1.25 volts. As the temperature further decreased, the voltage 460 on the capacitor 450 increased linearly to 29 volts, at which point the output of the temperature sensor was 3.15 volts. As shown by trace 470 in FIG. 6, the output of the temperature sensor 430 was modeled as a voltage source that increased with temperature. Note that the feedback resistor 422 and the temperature signal input resistor 424 changed the gain of the system, which in turn affected the slope of the transition 460 from $V_{MIN}$ to $V_{MAX}$.

Figure 7:
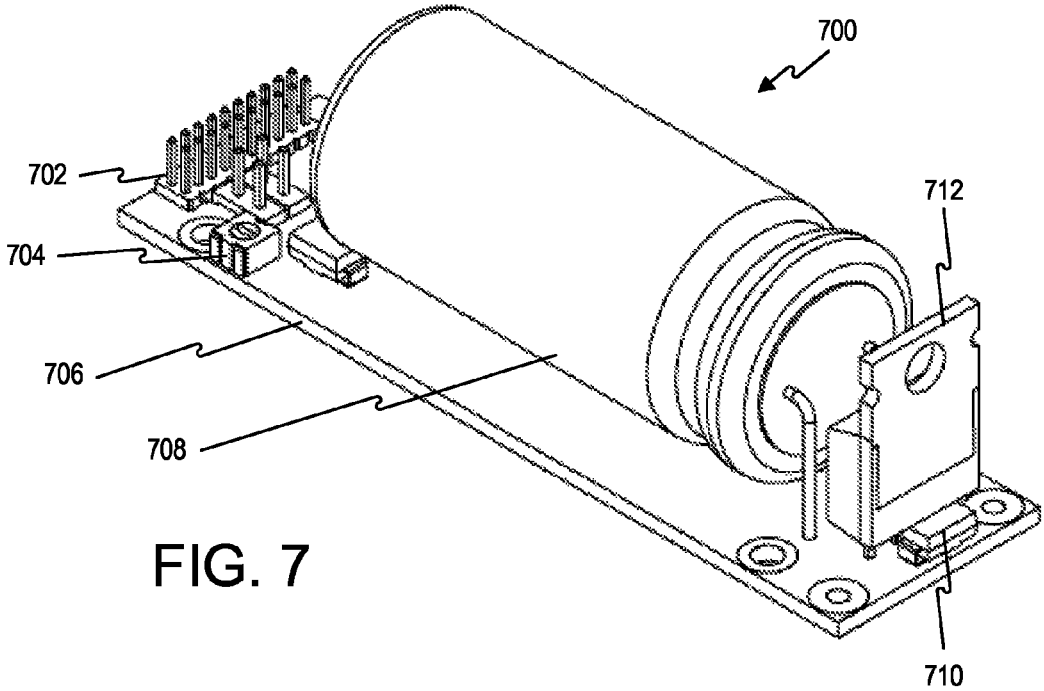
FIG. 7 is a perspective view of an illustrative physical implementation of a pulsed laser diode driver circuit.
Figure 8:
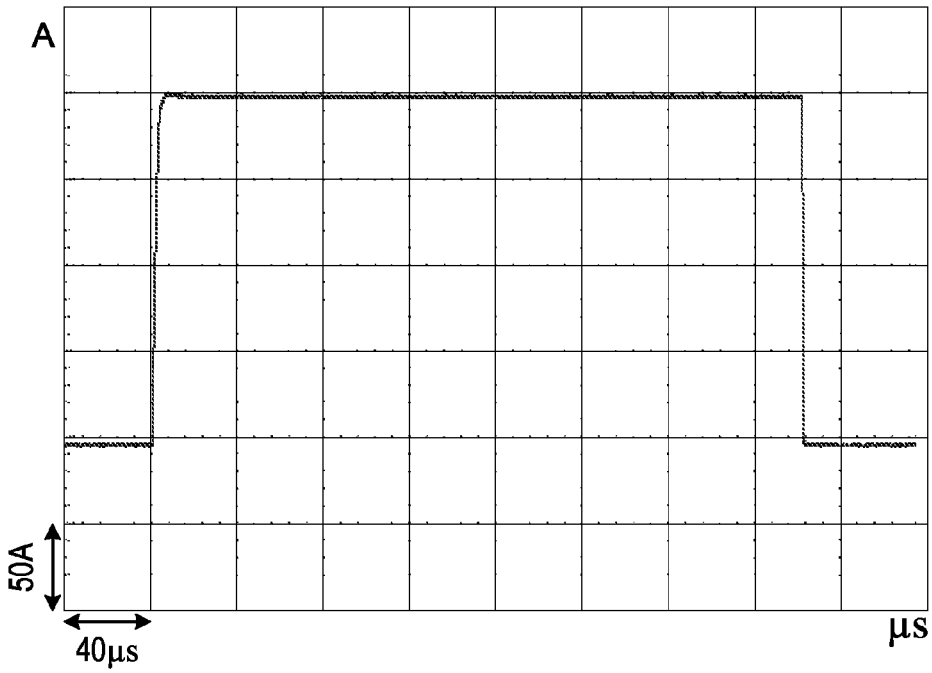
FIG. 8 is an illustrative graph of an output current pulse produced by the driver shown in FIG. 7.

The circuit of FIG. 4 may be implemented in any number of different ways to achieve the desired physical and electrical characteristics. FIG. 7 is a perspective view of an implementation 700 of the driver circuit of FIG. 4 as an ultra-miniature, battery operated, laser diode driver for driving a single laser diode bar to 200 amps of peak current. The major components visible in this view are a circuit board 706, a 20 position header 702, a potentiometer 704, an output capacitor 708, a temperature sensor (not visible) located on top of the circuit board 706 but under the capacitor 708, an anti-parallel diode 710, and a MOSFET 712. Component values were selected to produce current pulses like the one shown in FIG. 8, namely a 300 μs pulse having a flat top amplitude of 202 amps, a leading edge rise time of 2.725 μs, and a trailing edge fall time of 294.7 ns. Having a compact size and weight of only 22 grams, the driver 700 was well suited for man-portable and airborne applications. The magnitude of the output current was controlled either by the on-board potentiometer 704 or a user supplied DC voltage. The input trigger signal controlled the pulse width. An optional Universal Interface Board (UIB-01) allowed the user easy access to all control pins via the header 702. Commonly used signals were available on the UIB-01, such as the input trigger and the current monitor which allowed the user a real time view of the laser diode current. The driver 700 was powered by a +5 volt supply, which may be a battery if desired. The specifications for the driver 700 were as listed in Table 1 below.

TABLE 1

| Specifications | |
|---|---|
| Parameter | Value |
| Pulse Output Current (Load = Single Laser Diode Bar) | |
| Amplitude Range | 0-200 amps |
| Means of Adjustment | Internal adjustment with potentiometer or user supplied DC voltage (1.00 volts = 100 amps) |
| Pulse Rise/Fall Time | <4 μs |
| Pulse Width | 0-300 μs (set by user supplied input trigger) |
| Pulse Recurrence Frequency Range | Single shot to 1 PPS |
| Compliance Voltage | 3 volts (single bar) |
| Output Connection | Twisted pair AWG 16, 6" length |
| Trigger Requirements | |
| Type | +3.3 to +5 volt CMOS. The width of the trigger signal determines the output pulse width. |
| Outputs | |
| Current Monitor | 1.00 volt/100 amps into >10 kOhm<br>0.50 volt/100 amps into 50 Ohm |
| General | |
| Input Power | +2.2 to +5.5 VDC |
| Temperature Range | −40° C. to +70° C. |
| Dimensions (H × W × D) in inches | 0.91" × 0.75" × 2.69" (approximately) |
| Weight | 22 grams (0.78 ounces) |

The driver 700 is available as model PLDD-200-1-1 from OptiSwitch Technology Corporation of San Diego, Calif., USA.

In one variation of the pulsed laser diode driver circuit, the servo may be omitted if less stability and increased current rise time is tolerable.

Although the various implementations described herein are used for driving laser diode loads, they are also suitable for driving light emitting diode ("LED") loads. The term LED is intended to be broadly defined to mean an individual light emitting diode device, individual light emitting diode devices connected in series or in parallel or in any combination thereof, or a LED bar such as a monolithic element having multiple light emitting elements connected in series or in parallel or in any combination thereof. Many different types of LED's are available. The term "pulsed diode light source driver" refers to a driver for a laser diode as well as a driver for an LED.

The description of the invention including its applications and advantages as set forth herein is illustrative and is not intended to limit the scope of the invention, which is set forth in the claims. Variations and modifications of the embodiments disclosed herein are possible, and practical alternatives to and equivalents of the various elements of the embodiments would be known to one of ordinary skill in the art upon a study of this patent document. Moreover, unless otherwise stated the various values and geometries are approximations, and various properties are not necessarily exclusive of other properties, as would be appreciated by one of ordinary skill in the art. Terms such as capacitance, inductance and resistance do not preclude parasitics, for example. These and other variations and modifications of the embodiments disclosed herein, including of the alternatives and equivalents of the various elements of the embodiments, may be made without departing from the scope and spirit of the invention.

The invention claimed is:

1. A pulsed diode light source driver comprising:

a diode driver section comprising a switchable linear current driver coupled in series with a plurality of diode nodes for connecting to a diode light source;

a power supply having an output coupled to the diode driver section for providing an output voltage thereto, and an adjust node for controllably varying the output voltage as a function of deviation in an electrical property at the adjust node from a predetermined value;

an output capacitor coupled to the output of the power supply;

a temperature sensor physically disposed relative to the output capacitor for indicating temperature thereof with a temperature-varying signal;

a conditioning circuit for perturbing the electrical property at the adjust node from the predetermined value as a function of the temperature-varying signal to thereby vary the output voltage of the power supply in accordance with a voltage-temperature profile for the output capacitor, the conditioning circuit being coupled to the temperature sensor for receiving the temperature-varying signal; and a voltage monitor for restoring the electrical property at the adjust node to the predetermined value as a function of change in the output voltage of the power supply to thereby vary the output voltage of the power supply in accordance with the voltage-temperature profile for the output capacitor, the voltage monitor being coupled to the output of the power supply;

wherein the pulsed diode light source driver is operable for maintaining current pulses from the diode driver section constant over a temperature range, and the voltage-temperature profile for the output capacitor is operatively effective for maintaining current pulses from the diode driver section constant over a low end of the temperature range.

2. The diode driver of claim 1 wherein the conditioning circuit is operatively responsive to an indication in the temperature-varying signal of decreasing temperature, within the low end of the temperature range, for perturbing the electrical property of the adjust node to thereby increase the output voltage of the power supply.

3. The diode driver of claim 2 wherein the conditioning circuit is operatively responsive to an indication in the temperature-varying signal of decreasing temperature in a range of from about 0 degrees Centigrade to about minus 40 degrees Centigrade for perturbing the electrical property of the adjust node to thereby increase the output voltage of the power supply.

4. The diode driver of claim 1 wherein:

the voltage monitor comprises a voltage divider having a first branch coupled to the second branch at a midpoint, the first branch being coupled to the output of the power supply, and the midpoint being coupled to the adjust node; and the conditioning circuit is operatively responsive to an indication from the temperature sensor of varying temperature within the low end of the temperature range for sinking or sourcing current at the adjust node.

5. The diode driver of claim 1 wherein the voltage-temperature profile for the output capacitor is operatively effective for maintaining current pulses from the diode driver section constant over a high end of the temperature range.

6. The diode driver of claim 5 wherein the conditioning circuit is operatively responsive to an indication in the temperature-varying signal of increasing temperature, within the high end of the temperature range, for perturbing the electrical property of the adjust node to thereby decrease the output voltage of the power supply.

7. The diode driver of claim 1 wherein the conditioning circuit comprises:

a set voltage node;

an operational amplifier having an inverting input, a non-inverting input, and an output, one of the inverting and non-inverting inputs being coupled to the set voltage node, and the other of the inverting and non-inverting inputs being coupled to the temperature sensor; and a resistance-containing network having one terminus coupled to the output of the operational amplifier, and another terminus coupled to the adjust node of the power supply through the voltage monitor.

8. A pulsed diode light source system comprising:

a diode driver section comprising a diode light source and a switchable linear current driver coupled in series with the diode light source;

a power supply having an output coupled to the diode driver section for providing an output voltage thereto, and an adjust node for controllably varying the output voltage;

an output capacitor coupled to the output of the power supply;

a temperature sensor physically disposed relative to the output capacitor for indicating temperature thereof with a temperature-varying signal;

a conditioning circuit for perturbing the electrical property at the adjust node from the predetermined value as a function of the temperature-varying signal to thereby vary the output voltage of the power supply in accordance with a voltage-temperature profile for the output capacitor, the conditioning circuit being coupled to the temperature sensor for receiving the temperature-varying signal; and a voltage monitor for restoring the electrical property at the adjust node to the predetermined value as a function of change in the output voltage of the power supply to thereby vary the output voltage of the power supply in accordance with the voltage-temperature profile for the output capacitor, the voltage monitor being coupled to the output of the power supply;

wherein the pulsed diode light source driver is operable for maintaining current pulses from the diode driver section constant over a temperature range, and the voltage-temperature profile for the output capacitor is operatively effective for maintaining current pulses from the diode driver section constant over a low end of the temperature range.

9. The system of claim 8 wherein:

the voltage monitor comprises a voltage divider having a first branch coupled to the second branch at a midpoint, the first branch being coupled to the output of the power supply, and the midpoint being coupled to the adjust node; and the conditioning circuit is operatively responsive to an indication from the temperature sensor of varying temperature within the low end of the temperature range for sinking or sourcing current at the adjust node.

10. The system of claim 8 wherein:

the voltage-temperature profile for the output capacitor is operatively effective for maintaining current pulses from the diode driver section constant over a high end of the temperature range; and the conditioning circuit is operatively responsive to an indication in the temperature-varying signal of increasing temperature, within the high end of the temperature range, for perturbing the electrical property of the adjust node to thereby decrease the output voltage of the power supply.

11. The system of claim 8 wherein the conditioning circuit comprises:

a set voltage node;

an operational amplifier having an inverting input, a non-inverting input, and an output; wherein one of the inverting and non-inverting inputs is coupled to the set voltage node, and the other of the inverting and non-inverting inputs is coupled to the temperature sensor; and a resistance-containing network having one terminus coupled to the output of the operational amplifier, and another terminus coupled to the output voltage adjust node of the power supply through the voltage monitor.

12. The system of claim 8 wherein the diode light source is a laser diode.

13. The system of claim 8 wherein the diode light source is a light emitting diode.

14. A method for driving a diode light source with current pulses, comprising:

driving the diode light source with current pulses from a switchable linear current driver over an operating temperature range;

providing an output voltage from an output of a variable output power supply to the switchable linear current driver, the output having an output capacitor coupled thereto;

sensing temperature of the output capacitor with a temperature sensor physically disposed relative to the output capacitor for indicating temperature thereof; and increasing the output voltage from the variable output power supply in response to an indication from the temperature sensor of decreasing temperature within a low end of the operating temperature range, to maintain constant the current pulses from the switchable linear current driver to the diode light source.

15. The method of claim 14 further comprising decreasing the output voltage from the variable output power supply in response to an indication from the temperature sensor of increasing temperature within a high end of the operating temperature range, to maintain constant the current pulses from the switchable linear current driver to the diode light source.

* * * * *